US010576503B2

(12) United States Patent
Amaravadi

(10) Patent No.: US 10,576,503 B2
(45) Date of Patent: Mar. 3, 2020

(54) APPARATUS, SYSTEM AND METHOD FOR MOVING MATERIAL DISCHARGED FROM A VIBRATORY SEPARATOR

(71) Applicant: M-I L.L.C., Houston, TX (US)

(72) Inventor: Venkata Kasi Amaravadi, Tomball, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/528,076

(22) PCT Filed: Nov. 17, 2015

(86) PCT No.: PCT/US2015/060999

§ 371 (c)(1),
(2) Date: May 18, 2017

(87) PCT Pub. No.: WO2016/085701

PCT Pub. Date: Jun. 2, 2016

(65) Prior Publication Data

US 2017/0312788 A1 Nov. 2, 2017

Related U.S. Application Data

(60) Provisional application No. 62/085,013, filed on Nov. 26, 2014.

(51) Int. Cl.
*B07B 13/16* (2006.01)
*E21B 21/06* (2006.01)

(52) U.S. Cl.
CPC ..... *B07B 13/16* (2013.01); *E21B 21/065* (2013.01); *B07B 2201/04* (2013.01)

(58) Field of Classification Search
CPC ..... B07B 1/46; B07B 1/50; B07B 2201/04; B07B 13/16; E21B 43/34; E02F 5/28; E02F 5/285; B21D 21/12; B21D 21/2483; H02K 41/00; H02K 41/02
See application file for complete search history.

(56) References Cited

U.S. PATENT DOCUMENTS 1,879,135 A * 9/1932 Downes ..... B01D 21/0024 210/526
2,791,129 A 5/1957 Russel
2,943,216 A * 6/1960 Spodig ..... B25D 11/064 173/117
3,677,407 A 7/1972 McIlvaine
3,920,558 A * 11/1975 Lind ..... B01D 21/04 210/527

(Continued)

*Primary Examiner* — Joseph C Rodriguez
(74) *Attorney, Agent, or Firm* — Paula B. Whitten

(57) ABSTRACT

A collection system for collecting materials, such as cuttings, drilling fluid, wellbore fluid, lost circulation material, hydrocarbons and mixtures thereof, from a vibratory separator in a collection trough and facilitating movement of the collected materials to a discharge conduit utilizing a squeegee member. The squeegee may be moved along a track between the discharge conduits to move the material in the collection trough to the discharge conduits. The squeegee may be moved pneumatically or hydraulically. The squeegee may also be moved along the track magnetically utilizing a magnetic piston train. Movement of the squeegee can be modulated based on the rate of material into the collection trough.

20 Claims, 4 Drawing Sheets

(56) References Cited

U.S. PATENT DOCUMENTS

| | | | | |
|---|---|---|---|---|
| 4,152,253 | A | 5/1979 | Summers | |
| 4,190,541 | A * | 2/1980 | Wade | B01D 21/04 210/241 |
| 4,371,798 | A * | 2/1983 | Kuroda | H02K 9/10 310/103 |
| 6,313,551 | B1 | 11/2001 | Hazelton | |
| 6,530,482 | B1 * | 3/2003 | Wiseman | B01D 33/0346 209/253 |
| 7,703,612 | B2 * | 4/2010 | Browne | B01D 21/283 209/311 |
| RE44,906 | E * | 5/2014 | Rieberer | E21B 49/005 73/863.23 |
| 8,720,608 | B2 * | 5/2014 | Downton | E21B 4/06 175/293 |
| 9,636,607 | B2 * | 5/2017 | Mueller | B24C 9/003 |
| 9,677,353 | B2 * | 6/2017 | Burnett | B01D 33/0376 |
| 9,752,399 | B2 * | 9/2017 | Timmerman | E21B 21/063 |
| 9,795,901 | B2 * | 10/2017 | Downey | B01D 21/2461 |
| 9,871,433 | B2 * | 1/2018 | Satou | H02K 41/02 |
| 2011/0297373 | A1 | 12/2011 | Timmerman et al. | |
| 2013/0149089 | A1 | 6/2013 | Harms, Jr. et al. | |
| 2014/0166592 | A1 | 6/2014 | Holton | |

* cited by examiner

APPARATUS, SYSTEM AND METHOD FOR MOVING MATERIAL DISCHARGED FROM A VIBRATORY SEPARATOR

CROSS-REFERENCE TO RELATED APPLICATION

The present application claims the benefit of, and priority to, U.S. Provisional Patent Application No. 62/085,013, filed Nov. 26, 2014, which is hereby incorporated by reference in its entirety.

BACKGROUND

Separators are used in various industries to separate components of a mixture. For example, separators can be used to separate solid components from a mixture or liquids from a solid-liquid mixture. Vibratory separators use vibrational energy to separate components. Vibratory separators are used in various industries.

One such industry is the oil and gas industry. Drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. The shale shaker may be angled table with a generally perforated filter screen bottom. Returning drilling fluid is deposited at the feed end of the shale shaker. As the drilling fluid travels down length of the vibrating table, the fluid falls through the perforations to a reservoir below leaving the solid particulate material behind. The vibrating action of the shale shaker table conveys solid particles left behind until they fall off the discharge end of the shaker table. The above-described apparatus is illustrative of one type of shale shaker known to those of ordinary skill in the art.

Recently, drilling fluids containing bridging materials, also known in the art as wellbore strengthening materials or loss prevention materials, have seen increased use in drilling operations where natural fractures in the wellbore allow drilling fluid to escape from the circulating system. Wellbore strengthening materials are typically mixed into the drilling fluid and used to bridge the fractures to prevent fluid loss into the formation. Such wellbore strengthening materials are also used in stress cage drilling, which involves intentionally creating fractures in the wellbore and bridging the fractures with the materials. Such applications create a hoop stress and stabilize the formation.

Wellbore strengthening materials typically are more expensive than other additives used in drilling fluid components. Thus, drillers benefit when wellbore strengthening materials are recovered during waste remediation.

Accordingly, collection and movement materials from a separator, whether oilfield or non-oilfield related, is generally beneficial to the industry.

DESCRIPTION OF FIGURES

The foregoing and other features of the present disclosure will become more fully apparent from the following description, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

While some of the example embodiments utilize a vibratory separator in the oilfield industry as an example, the invention should not be deemed as limited to the vibratory separator or the oilfield industry. A person of ordinary skill in the art will appreciate that the embodiments of the disclosure are applicable to other types of separators and other vibratory separators outside of the oilfield industry. The inventors herein contemplate the use of the embodiments disclosed herein in many fields, including industrial screening applications.

In one aspect, embodiments disclosed herein relate generally to a collection system for collecting materials from a vibratory separator. In another aspect, embodiments disclosed herein relate to a collection trough for collecting wellbore strengthening materials from deck of a shaker. More specifically, embodiments disclosed herein relate a collection trough with a squeegee member for facilitating removal of the materials in the collection trough out through a discharge conduit.

Figure 1:
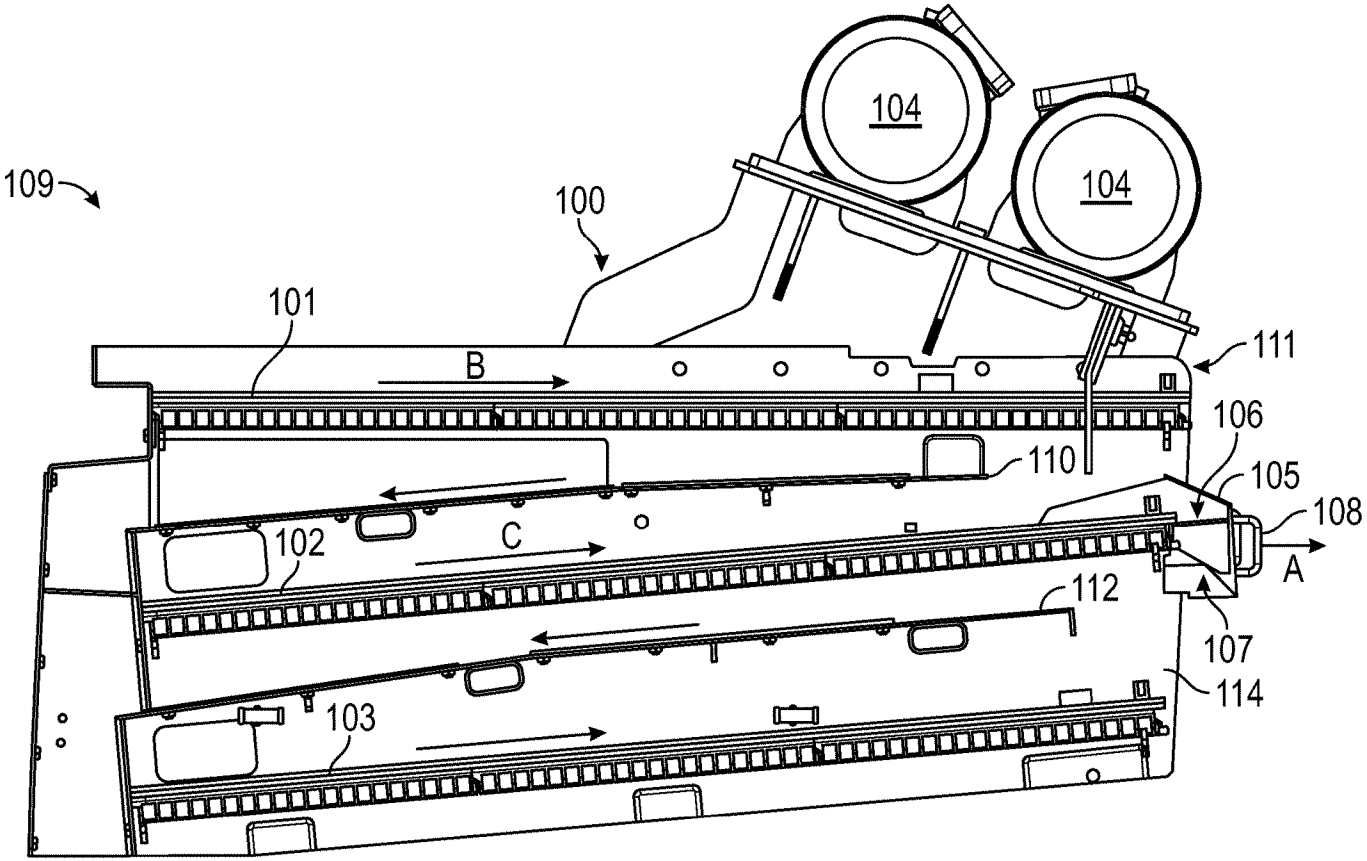
FIG. 1 illustrates a separator having a collection trough that collects material.

Referring to FIG. 1, a cross-section plan view of a vibratory separator having a collection trough according to embodiments of the present disclosure is shown. In some embodiments, vibratory separator 100 includes three decks 101, 102, and 103, wherein top deck 101 is a scalping deck, middle deck 102 is a second cut deck, and bottom deck 103 is a fines deck. Vibratory separator 100 also includes two motion actuators 104 configured to provide a motion to decks 101, 102, and 103 during operation. As illustrated, a collection trough 105 is in fluid communication with middle deck 102. Collection trough 105 may be formed from various materials, such as steel, and may include various coatings to prevent corrosion during operation.

Each deck 101, 102, and 103 may include one or more screens (not independently illustrated). The screens include a plurality of perforations of a particular size, thereby allowing fluids and solids entrained therein that are smaller than the size of the perforations to flow through the screens, while particular matter larger than the screen is retained on top of the screen for further processing. Those of ordinary skill in the art will appreciate that the screens on each of decks 101, 102, and 103 may have different perforation sizes, such that the over flow (the retained solids) from each screen are a different sizes. In such an embodiment, the retained solids from deck 101 may be of a larger size than the retained solids from decks 102 and 103. Thus, by selecting different perforation size for screens on decks 101, 102, and 103, a specific solid size from each deck may be retained. Those of ordinary skill in the art will appreciate that depending on the requirements of a separatory operation, one or more of the screens on decks 101, 102, and/or 103 may also have screens with perforations of the same or substantially the same size.

As drilling fluid containing particulate matter (slurry) enters vibratory separator 100 though an inlet side 109, the slurry flows in direction B, such that fluid and undersized particles form an underflow (i.e., fluids and particulate matter that passes through screens), pass through a screen on first deck 101 and into a first flow back pan 110. The overflow (e.g., drill cuttings or large solids) that did not pass through the screen(s) on first deck 101 may then be discharged from first deck 101 at large particulate discharge point 111. The underflow then flows down first flowback pan 110 and onto deck 102. The mesh used on screens of the deck 102 may be selected such that a predetermined material size or material, such as wellbore strengthening materials, is retained on screen 102. Thus, fluids and particulate matter smaller than the perforations in the screen(s) on deck 102 fall through middle deck 102 screen and onto second flowback pan 112, while wellbore strengthening materials are retained on the screen(s) and moved in direction C.

Vibratory separator 100 also includes a collection trough 105 coupled to at least one of the decks 101, 102, or 103 of vibratory separator 100. The collection trough 105 may be removably coupled or permanently coupled to the vibratory separator 100. In this embodiment, collection trough 105 is illustrated coupled to middle deck 102. As illustrated, collection trough 105 is configured to receive a flow of solid overflow from the second deck 102, which includes solids that are too large to fit through the apertures in a screen on second deck 102. It will be appreciated by those having ordinary skill in the art that the solids may contain liquid material, such as drilling fluid, wellbore fluid, hydrocarbons, water or other fluids. In certain aspects, the solids that are collected in collection trough 105 may include wellbore strengthening materials, such as fluid wellbore strengthening materials that are designed to lower the volume of filtrate that passes through a filter medium and into the formation. Other solids, such as drill cuttings may be entrenched or otherwise conveyed from the vibratory separator 100 with the wellbore strengthening material. Examples of wellbore strengthening materials, including lost circulation materials, include sized-salts, sized-calcium carbonates, polymers, sand, mica, nutshells (e.g, ground peanut shells and walnut shells), plant fibers, cottonseed hulls, ground rubber, other wellbore strengthening materials known in the art.

Collection trough 105, in this aspect, includes an inlet 106 configured to receive an overflow from the second deck 102 and an outlet 107 configured to direct the overflow to a storage vessel or the active drilling fluid system. The active drilling fluid system may include drilling fluid tanks, mixing tanks, or other containers located at the drilling site, where drilling fluids are mixed and stored prior to use during drilling. Collection trough 105 may include handles 108, which are configured to allow an operator to remove collection trough 105 when either wellbore strengthening materials are not being used or when collection of such wellbore strengthening materials is not required. In certain aspects, it may be desirable for the separation operation to continue without the collection of wellbore strengthening materials. In such an operation, the operator may simply remove collection trough 105 from the second deck 102 by sliding collection trough 105 in direction A. In certain embodiments, collection trough 105 may be secured to second deck through mechanical attachment points, such as bolts or screws, while in other aspects, collection trough 105 may be secured to deck 102 through a pneumatic actuation system, such as pneumatic systems typically used to secure screens to decks.

Those of ordinary skill in the art will appreciate that collection trough 105 may be disposed on other decks, such as first deck 101 or third deck 103 in certain separation operations. For example, in a return flow of drilling fluid with high solids content, it may be beneficial to collect wellbore strengthening materials from third deck 103, while in other operations, it may be beneficial to collect wellbore strengthening materials from first deck 101. In still other aspects, a collection trough may be used on more than one deck to collect multiple sized wellbore strengthening materials. Additionally, the location of collection trough 105 may be selected based on the perforation size of the screens on a particular deck or based on the size of the wellbore strengthening materials being collected.

Fluids and particulate matter that is smaller than a perforation size of a screen on deck 102 do not enter collection trough 105; rather, the fluids and fine particulate matter pass through the screen on middle deck 102 onto flow back pan 112. Fluids and particulate matter smaller than a screen on deck 103 flow through the screen into a reservoir or sump in vibratory separator 100 that is in fluid communication with the active drilling fluid system. Fines that are larger than the perforation on screens disposed on the bottom deck 103 are discharged from the vibratory separator at discharge point 114 for disposal thereafter.

In certain applications the flow through vibratory separator 100 may be modified by, for example, providing for a bypass of one or more of the decks 101, 102, and/or 103. Additionally, series and/or parallel flow may be achieved by diverting a flow of fluid around one or more of decks 101, 102, 103, or away from one or more of flow back pans 110 and/or 112.

Figure 2:
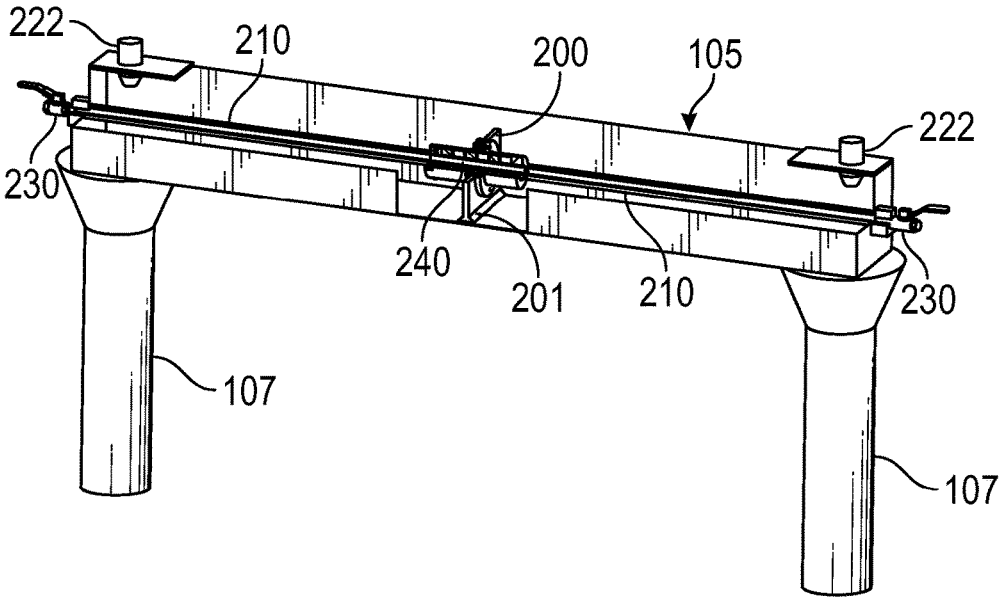
FIG. 2 illustrates a sectional view of a collection trough with a squeegee member that may be used with a separator in some embodiments of the disclosure.

Turning now to FIG. 2, FIG. 2 illustrates a squeegee member 200 that may be used to move material in the collection trough 105. The squeegee member 200 is movable within the collection trough 105 to move the materials received in the collection trough 105, as described above, toward the outlets 107. The materials in the collection trough 105 may be cuttings, drilling fluid, wellbore fluid, lost circulation material, hydrocarbons and a mixture thereof (hereinafter "material" or "materials"). Of course, this is merely an embodiment of the materials as other materials may be conveyed by the present disclosure.

The material can move into the outlets 107 to be conveyed to further separation equipment, moved into the "possum belly", e.g. sump of the vibratory separator 100, or otherwise collected, moved or further conveyed. The squeegee member 200 may have a vertical height approximate to the height of the collection trough 105, or may be less than the collection trough 105. Having the height of the squeegee member 200 less than the collection trough 105 may prevent the material from falling over the collection trough 105 as moved by the squeegee member 200 toward the outlets 107. The squeegee member 200 may be constructed of a sturdy, rigid material, such as plastic, metal, composite, or other rigid or durable material. A substance non-reactive with the material may be utilized to prevent damage to the squeegee 200. A bottom portion 201 of the squeegee 200 may be made of a different substance. For example, the bottom portion 201 may be constructed of rubber or a substance that if contacting the collection trough 105 can move the materials on the collection trough 105 without damaging the squeegee 200. The bottom portion 201 may engage the collection trough 105 partially to move the materials on a surface of the collection trough 105. For example, the bottom portion 201 may contact the collection trough 105 to squeegee or otherwise move the material along the collection trough 105.

Nozzles 222 are provided to spray liquid on the material to move it into the outlets 107. The nozzles 222 may provide a turbulent flow of liquid or fluid to force or convey the fluid into the outlets 107. The liquid may be drilling or wellbore fluid that has been screened by the vibratory separator 100, virgin or unused drilling fluid, oil, water or other liquid as will be appreciated by those having ordinary skill in the art. Gas may also be used, such as air.

The squeegee 200 may move along a track 210 between the outlets 107 to move the material in the collection trough 105 to the outlets 107. The speed of the back and forth motion of the squeegee 200 can depend upon the flow rate of the material into the collection trough 105, the density of the material, and/or the flow rate of wellbore fluid being provided to the vibratory separator 100.

Various methods and mechanisms may be used to generate movement of the squeegee 200. The embodiments that follow are examples of energy that may be imparted to the squeegee 200 to move it along the track 210. Of course, a person having ordinary skill in the art will appreciate that slight modifications and combinations of these embodiments are within the scope of the disclosure.

As shown in FIG. 2, the squeegee 200 can be moved pneumatically or hydraulically. Gas or fluid can be provided to the track inlets 230 to control movement of the squeegee 200 along the collection trough 105. For example, air may be provided at one of the track inlets 230 and impart motion on a piston 240 that may be connected to the squeegee 200. The air may force the piston 240 to move along the track 210 away from the track inlet 230 providing the air. The piston 240 may, in some embodiments, be a double acting cylinder to ensure movement along the track 210 in both directions. Hydraulic fluid may be used in a similar fashion to drive the piston back and forth along the track 210. The pneumatic of hydraulic conveyance of the squeegee 200 may be controlled by an operator or automatically controlled based on time, flow rate of the material, wellbore conditions, rig conditions or other factors that will be appreciated by those having ordinary skill in the art.

Figure 3:
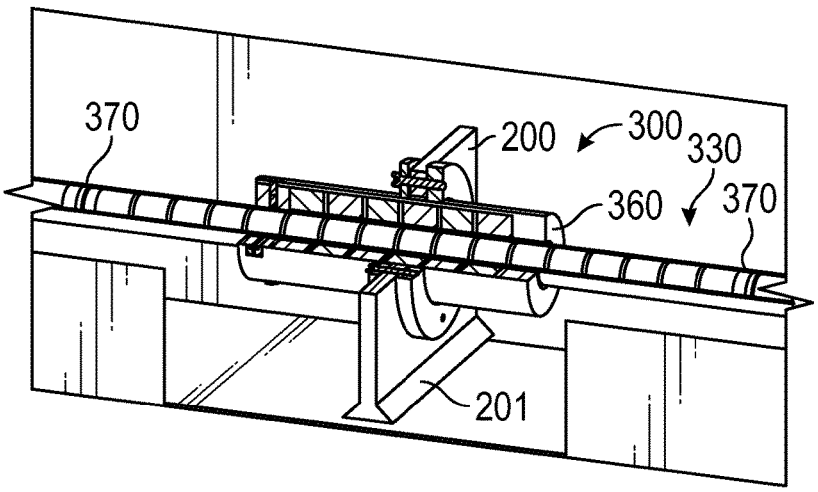
FIG. 3 illustrates a cross-sectional view of a linear magnetic coupling device that may be used with a collection trough in some embodiments of the disclosure.
Figure 4:
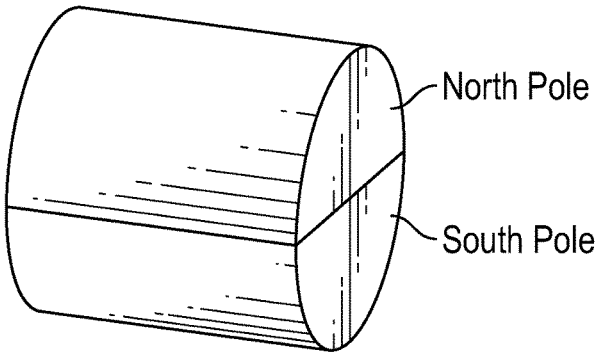
FIG. 4 illustrates a cylindrical magnet that may be used with a collection trough in some embodiments of the disclosure.

As another example, the squeegee 200 may be moved magnetically as shown in FIG. 3. For example, a linear magnetic coupling device 300 comprising a magnetic piston train 330 and a follower 360. In some embodiments, the magnetic piston train 330 may comprise a number of diametrically magnetized cylindrical magnets arranged with adjacent alternating poles, as shown in FIG. 4. The magnetic piston train 330 may comprise any shaped magnets or magnetic materials capable of being magnetized such that they produce alternating fluxes. In some embodiments, a magnetic piston 370 is provided at each end of the magnetic piston train 330.

Figure 5:
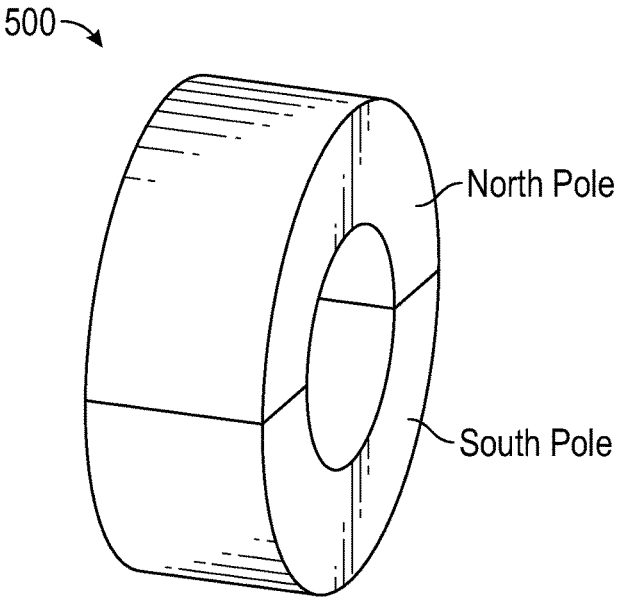
FIG. 5 illustrates a ring magnet that may be used with a collection trough in some embodiments of the disclosure.
Figure 6:
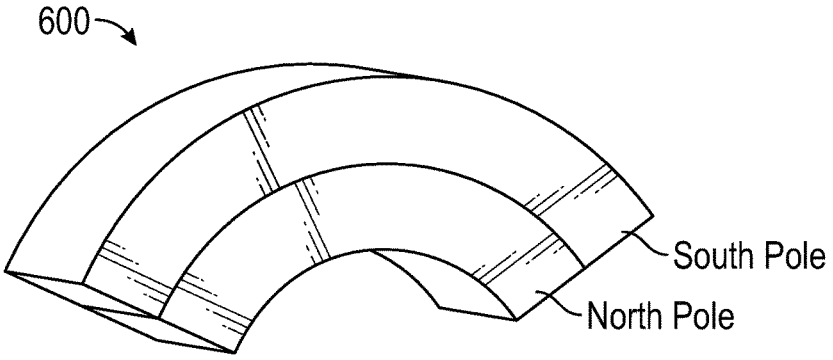
FIG. 6 illustrates a magnetized arc that may be used with a collection trough in some embodiments of the disclosure.
Figure 7:
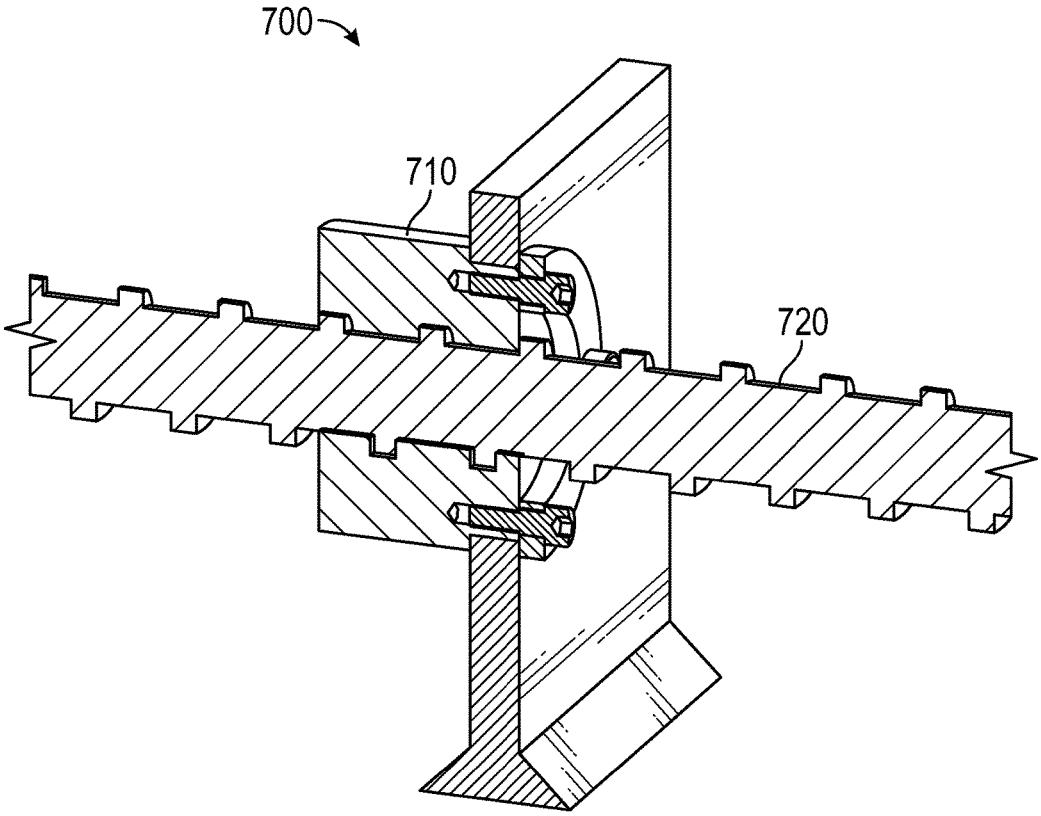
FIG. 7 illustrate a lead screw mechanism that may be used with a separator in some embodiments of the disclosure.

The follower 360 may be secured or otherwise coupled to the squeegee 200 and generally move with the squeegee 200. The magnetic piston train 330 may attract the follower 360 to cause movement of the squeegee 200 if the magnetic piston train 330 is moved. The follower 360 may comprise one or more magnets as shown in FIG. 3. The squeegee 200, the follower 360 and the magnetic piston train 330 move generally together, back and forth upon a force applied to the magnetic piston 370, such as pneumatic or hydraulic pressure. For example, cyclical differential pneumatic pressure generated using, for example, a timed pneumatic circuit can drive the magnetic piston 370 toward the outlets 107. The pneumatic circuit may not be timed but may correspond to or be based upon flow rate of the material, an amount or rate of fluid mixture being provided to the vibratory separator 100, or by other factors. When a suitable differential pressure is applied to the magnetic piston train 330, the magnetic piston train 330, and thus the squeegee 200, can move towards the low pressure side. The speed of the magnetic piston train 330 can be controlled by the applied differential pressure. The follower 360 moves with a similar speed as the magnetic piston train 330 due to the magnetic forces between the follower 360 and the magnetic piston train 330. The follower 360 can be magnetic. For example, the follower 360 can have diametrically magnetized ring magnets 500 arranged with adjacent alternating poles, such as those shown in FIG. 5 or diametrically magnetized arc magnets 600 arranged with adjacent alternating poles, such as shown in FIG. 6. The magnets in both the magnetic piston train 330 as well as the follower 360 may or may not be separated by a magnetically inert spacer. The follower 360 can, in some embodiments, be non-magnetic but made out of ferric metal, such as malleable soft iron. The follower 360 is rigidly attached to the squeegee 200. The follower 360 can move the squeegee 200 and hence the material toward either of the outlets 107. The weight of the materials and the friction produced during moving the material are the forces opposing the movement of the follower 360 and the squeegee 200. This force has to be countered by the shearing component of the magnetic force between the magnetic piston train 330 and the follower 360.

Another example mechanism to move the squeegee 200 within the collection trough 105 is a lead screw assembly 700. The squeegee 200 may be attached to a nut 710 coupled to the squeegee 200. A lead screw 720 of the lead screw assembly 700 can be connected to a driving mechanism, such as an electric or pneumatic motor. The lead screw 720 can be rotated at a predetermined speed to move the nut 710 and thus the squeegee 200. As the lead screw 720 rotates clockwise and counterclockwise, the nut 710 and as result the squeegee 200 can move back and forth.

The rotational (angular) speed of the lead screw 720 can depend upon the pitch of the lead screw 720. Reversing the rotation of the lead screw 720 can move the nut 710, which may be rigidly attached to the squeegee 200, in the opposite direction. Hence, the squeegee 200 can be moved toward and away from the outlets 107 by rotating the lead screw 720 in the appropriate direction. The lead screw 720 and nut 710 can be moved away from the main flow path of the materials being fed into the collection trough 105. In addition, a guard (not shown) could be placed over the entire assembly to prevent contamination as well as for operator safety.

A person having ordinary skill in the art can appreciate that the mechanisms described above are not the only mechanisms for moving the squeegee 200. Other mechanisms are readily ascertainable and should not be deemed outside the disclosure. For example, a rack and pinion system may be used to move the squeegee 200. As a mere example, an externally placed rack parallel to the motion of the squeegee 200, such as parallel to the collection trough 105, can mate with a pinion attached to an electric motor, pneumatic motor or other driving mechanism. The squeegee 200 can be connected to the rack with a mechanical assembly. As the pinion is rotated clockwise and counterclockwise, the rack and the squeegee 200 can move within the collection trough 105 toward the outlets 107. Other mechanisms commonly used and combinations of the embodiments disclosed herein are contemplated by the inventors and should be appreciated by those having ordinary skill in the art.

What is claimed is:

1. A vibratory separator, comprising:

a deck comprising a screen;

a collection trough coupled to the deck and configured to receive a material flowing over a downstream edge of the deck; and a squeegee member positioned within the collection trough, wherein the squeegee member moves within the collection trough, thereby moving received material toward an outlet of the collection trough, wherein the squeegee member comprises a base connected to a bottom portion of the squeegee member such that the bottom portion is provided between the base and a surface of the collection trough adjacent to the bottom portion of the squeegee member, wherein the bottom portion has an overall width that increases along a height of the bottom portion from an upper end of the bottom portion adjacent to the base of the squeegee member to bottom end of the bottom portion adjacent to the surface of the collection trough.

2. The vibratory separator of claim 1, wherein the collection trough comprises at least two outlets, and wherein the squeegee member moves back and forth between the at least two outlets.

3. The vibratory separator of claim 1, further comprising a track positioned within the collection trough, wherein the squeegee member is coupled to and moves along the track.

4. The vibratory separator of claim 3, wherein the track includes an inlet configured to receive a gas, and wherein the squeegee member moves in response to the gas entering the inlet.

5. The vibratory separator of claim 4, further comprising a piston coupled to or positioned within the track, wherein the piston causes the squeegee member to move in response to the gas entering the inlet.

6. The vibratory separator of claim 1, further comprising:

a follower coupled to the squeegee member; and a magnetic piston train configured to attract the follower to cause the follower and the squeegee member to move within the collection trough.

7. The vibratory separator of claim 6, wherein the follower and the squeegee member move in response to movement of the magnetic piston train.

8. The vibratory separator of claim 7, wherein the magnetic piston train comprises a plurality of diametrically-magnetized magnets having adjacent alternating poles.

9. The vibratory separator of claim 7, wherein the follower comprises a plurality of diametrically-magnetized magnets having adjacent alternating poles.

10. The vibratory separator of claim 1, further comprising:

a lead screw positioned within the collection trough; and a nut configured to move axially-along the lead screw as the nut rotates about the lead screw, wherein the movement of the nut causes the squeegee member to move within the collection trough.

11. A vibratory separator, comprising:

a first deck comprising a first screen;

a second deck comprising a second screen, wherein the second deck is positioned below the first deck;

a collection trough coupled to the first deck and configured to receive a material flowing over a downstream edge of the first deck, wherein the material comprises a wellbore-strengthening material;

a squeegee member positioned within the collection trough, wherein the squeegee member moves back and forth within the collection trough, thereby moving the material toward one or more outlets in the collection trough, one or more nozzles provided directly above the one or more outlets in the collection trough and configured to provide a flow of liquid or fluid into the one or more outlets in the collection trough.

12. The vibratory separator of claim 11, wherein the wellbore-strengthening material comprises lost circulation materials, calcium carbonates, polymers, sand, mica, nutshells, plant fibers, cottonseed hulls, ground rubber, or a combination thereof.

13. The vibratory separator of claim 11, further comprising:

a track positioned within the collection trough, wherein the squeegee member is coupled to and moves along the track; and a piston coupled to or positioned within the track, wherein the piston causes the squeegee member to move in response to gas entering the track through an inlet in the track.

14. The vibratory separator of claim 11, further comprising:

a follower coupled to the squeegee; and a magnetic piston train configured to attract the follower to cause the follower and the squeegee to move within the collection trough, wherein the follower moves in response to movement of the magnetic piston train.

15. The vibratory separator of claim 11, further comprising:

a lead screw positioned within the collection trough; and a nut configured to move axially-along the lead screw as the nut rotates about the lead screw, wherein the movement of the nut causes the squeegee member to move within the collection trough.

16. A method for collecting a material from a vibratory separator, comprising:

introducing the material from a deck of the vibratory separator into a collection trough, wherein the material comprises a wellbore-strengthening material; and moving a squeegee member within the collection trough to move the material toward an outlet in the collection trough, wherein the squeegee member comprises a bottom portion extending downward towards a surface of the collection trough, wherein an overall width of the bottom portion increases as the bottom portion of the squeegee member nears the surface of the collection trough.

17. The method of claim 16, further comprising introducing gas into a track in the collection rough, wherein a piston moves along the track in response to the introduction of the gas into the track, and wherein the squeegee member moves in response to the movement of the piston.

18. The method of claim 16, further comprising moving a magnetic piston train, wherein a follower moves in response to the movement of the magnetic piston train, and wherein the squeegee member moves in response to the movement of the follower.

19. The method of claim 16, further comprising rotating a nut about a lead screw using a driving mechanism, wherein the nut and the lead screw are positioned at least partially within the collection trough, and wherein the squeegee member moves in response to the movement of the nut.

20. The method of claim 16, further comprising varying a speed of the squeegee member in response to a flow rate of the material into the collection trough or a density of the material.

* * * * *